US005678485A

United States Patent [19]

Guaraldi

[11] Patent Number: 5,678,485

[45] Date of Patent: Oct. 21, 1997

[54] COUNTERPOISE AND LIFT MECHANISM

[75] Inventor: Glenn A. Guaraldi, Kingston, N.H.

[73] Assignees: Heidelberger Druckmaschinen AG, Heidelberg, Germany; Heidelberg Harris, Inc., Dover, N.H.

[21] Appl. No.: 577,996

[22] Filed: Dec. 22, 1995

[51] Int. Cl.[6] ..... B41F 13/24

[52] U.S. Cl. ..... 101/247; 101/216

[58] Field of Search ..... 101/216, 217, 101/218, 247, 248, 152, 153, 375, 376, 143, 144, 145

[56] References Cited

U.S. PATENT DOCUMENTS 4,458,591 7/1984 Guaraldi .

5,101,726 4/1992 Lübke et al. ..... 101/216

5,237,920 8/1993 Guaraldi .

5,241,905 9/1993 Guaraldi et al. .

5,301,609 4/1994 Guaraldi et al. .

*Primary Examiner*—Ren Yan

*Attorney, Agent, or Firm*—Kenyon & Kenyon

[57] ABSTRACT

An apparatus for supporting a cylinder within a processing unit is provided, the cylinder having a releasable end portion and a removably sleeve mounted thereon. A counterpoise assembly is assigned to one end of the cylinder. The cylinder is supported on both ends by support housings. One of the support housings is supported, during throw-off of the cylinder, by a horizontally movable supporting device. A sliding device is assigned to the supporting device on the respective side frame.

21 Claims, 9 Drawing Sheets

35
39
38
37
380
370
36

31
31.1
180
13
32
12
33
19
15.1
16.1
15
16

COUNTERPOISE AND LIFT MECHANISM

FIELD OF THE INVENTION

The present invention relates to an apparatus for supporting a counterpoised cylinder within a processing unit.

BACKGROUND OF THE INVENTION

U.S. Pat. No. 4,458,591 discloses a rotary printing press in which the angle between a blanket and a plate cylinder is varied by means of a skew mechanism. A plate cylinder throw-off mechanism moves the plate cylinder to disengage the plate cylinder from the blanket cylinder. As the plate cylinder is thrown off, a cam maintains the center-to-center distance between form roll and plate cylinder. However, in this configuration, a release of a bearing and a support of a printing unit cylinder being released on one side is not disclosed or suggested.

U.S. Pat. No. 5,237,920 shows an apparatus for supporting a cylinder in a rotary printing unit. Bearing members of the printing unit are removable from the ends of printing unit cylinders. Counterpoise assemblies are provided which include levers which have an arced portion for exerting a force upon the gear side journals of the printing unit cylinders, the work side ends of which are released. Each of the counterpoise assemblies include a toggle member for moving the respective lever into its engaged position and for holding the lever in its engaged position against the weight of associated printing cylinder.

U.S. Pat. No. 5,241,905 discloses a printing unit with a releasable bearing clamp. The printing unit includes a door assembly having a door supported for pivotable movement on a frame wall. The door has a closed position in which it extends across an opening in the frame wall and an open position in which it does not extend across the opening in the frame wall. A clamping assembly clamps a bearing housing of a printing unit cylinder onto the door while the door is in the closed position. The clamping assembly includes a first clamp fixed to the door, and a second clamp which is supported on the door for movement relative to the first clamp into an open or closed position. In its closed position, the first clamp abuts the second clamp, thereby engaging the bearing housing of the printing unit cylinder. By moving the second clamp into an open position, the bearing housing is released. Once the second clamp is in the open position, the door assembly is swung into its open position allowing for access to the printing unit cylinder for exchange of a tubular sleeve. The door assembly is moveable with the printing unit cylinder for throw-off.

U.S. Pat. No. 5,301,609 discloses a printing unit with skew and throw-off mechanisms. An upper and a lower bracket, which support the ends of the plate cylinders, are moved by a skewing mechanism transversely relative to a frame independently of each other. A throw-off mechanism includes a pressure cylinder and a piston rod connected between the two brackets. The pressure cylinder and the piston rod are pivotally connected to the brackets and move pivotally relative to the brackets when the brackets are moved transversely by the skewing mechanism. The throw-off mechanism thus permits the brackets to be skewed independently of each other while remaining connected with each other for throw-off.

The above devices, however, fail to address the need to incorporate a lift mechanism into a printing unit cylinder for allowing axial removal of a sleeve from the thrown-off cylinder. In the above mentioned devices, in order to effectuate removal of a sleeve shaped form from a cylinder, the corresponding cylinder either remained stationary during throw off, or was thrown-off in a downward direction. It was not possible to lift the cylinder from which the sleeve was to be removed or mounted.

SUMMARY OF THE INVENTION

In accordance with the present invention, a counterpoise and lift mechanism is provided for moving a processing unit cylinder between a printing position and a throw-off position. The cylinder, having a first end and a second end, is supported on both ends by respective support housings. An axially mountable form, for example a sleeve, is removably mounted over the first end of the cylinder. It should be noted, however, that the axially mountable form need not be formed as a sleeve, i.e., it need not have a continuous tubular surface.

The cylinder can, for example, be a print cylinder having a sleeve shaped print form mounted thereon, or a blanket cylinder having a sleeve shaped printing blanket mounted thereon. A throw-off mechanism, coupled to the first and second support housings, moves the cylinder upward from the printing position to the throw-off position, and moves the cylinder downward from the throw-off position to the printing position. A counterpoise assembly is engageable to the second end of the cylinder at a point exterior to the second support housing. The counterpoise assembly is engaged with the second end of the cylinder when the cylinder in throw-off position and is disengaged from the second end of the cylinder when the cylinder is in point position. A supporting device is also provided. The supporting device engages and supports the second support housing when the cylinder is in throw-off position. In this manner, the cylinder is protected from a failure of the throw-off mechanism while in throw-off position. Once the counterpoise assembly and supporting device have been engaged, a release mechanism releases the first support housing from the first end of the cylinder, and the sleeve can be removed from the cylinder.

In accordance with further embodiments of the present invention, the throw-off mechanism includes an actuator (such as a pneumatic cylinder) and a linkage for lifting each respective support housing during throw-off. The support housings are pivotable about axes of respective side frames to allow for throw-off of the cylinder. Furthermore, an adjustable stop may be assigned to the respective support housings in order to control pressure in a nip between adjacent cylinder surfaces.

In accordance with another embodiment of the present invention, the supporting device moves horizontally between a first position in which the supporting device is disengaged from the gear side support housing, and a second position in which the supporting device supports the gear side support housing under control of an actuating unit. A sliding device, mounted to the gear side frame, may be provided beneath the gear side support housing to support the supporting device in the second position. To reduce friction between the supporting device and the gear side support housing as the supporting device moves into the second position, the gear side support housing may include a contacting member such as a cam follower, and the supporting device can include a corresponding contacting area having an inclined surface.

As one of ordinary skill in the art will appreciate, the respective actuators for the respective first and second support housings, and the actuating unit for the supporting device can be implemented in various ways. For example, these devices can be implemented as pneumatic cylinders, hydraulic cylinders or other suitable pressurized fluid based devices. Electric motors, solenoids or other electrically controlled devices are also suitable.

DETAILED DESCRIPTION OF THE INVENTION

Figure 1:
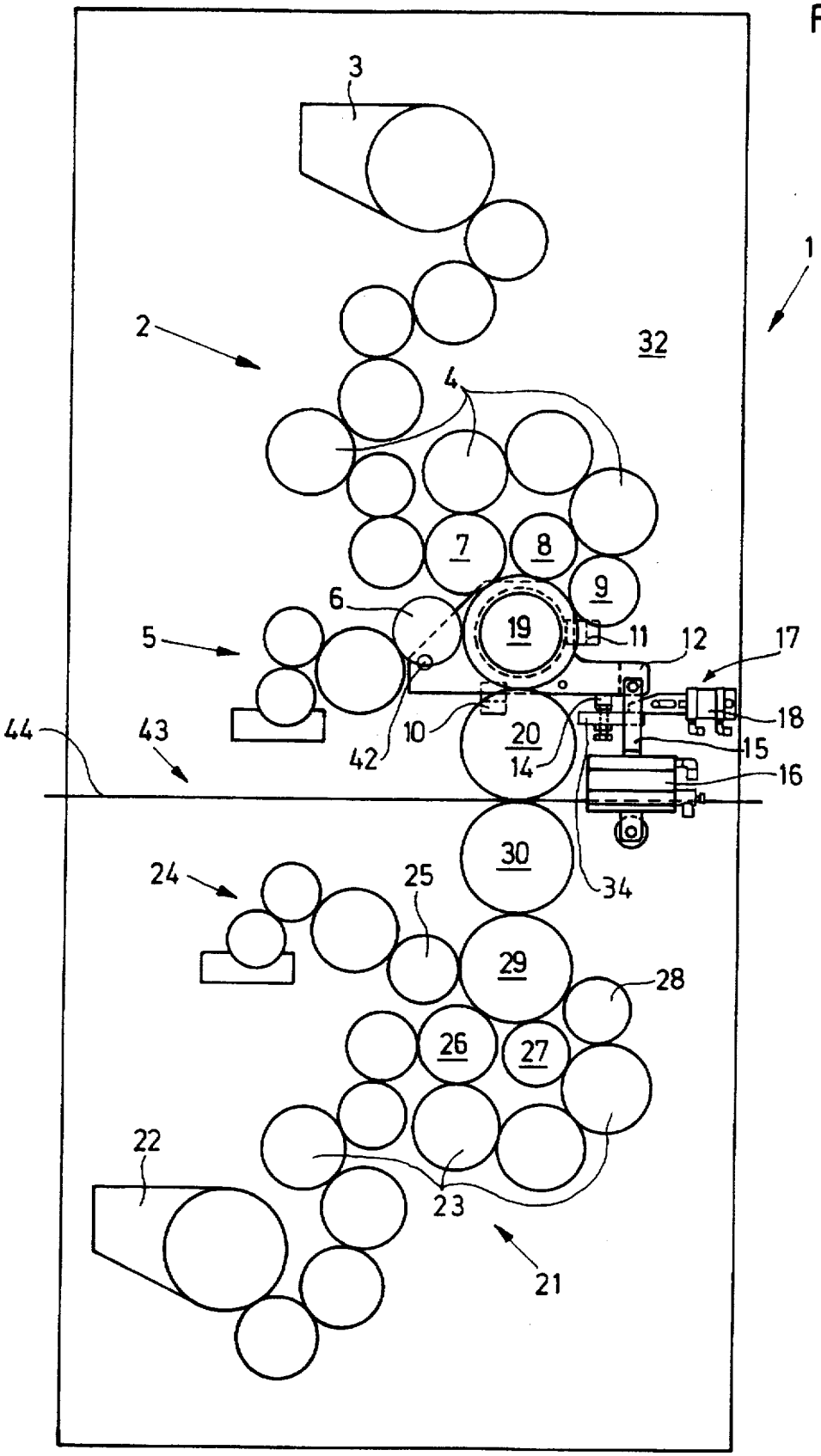
FIG. 1 shows an overall cross section of an offset lithographic printing unit.

Referring to FIG. 1, a printing unit 1 includes an upper inker 2 and a lower inker 21. A plurality of vibrator rollers 4 distribute ink supplied by an upper ink fountain 3. A dampening unit 5 is assigned to an upper first cylinder 19. A dampening applicator roller 6 and applicator roller 7, 8 and 9 supply dampening solution or ink, respectively to the surface of an axially mountable form, such as a sleeve-type tubular-shaped print form, which is mounted on the upper first cylinder 19. The rollers 6, 7, 8 and 9 can either adopt an engaged position or can be disengaged, i.e. can be thrown off from the upper first cylinders' surface, in a known manner.

Below a support housing 12 on a gear side 32, an adjustable stop 14 is mounted. The adjustable stop 14 can be set to adjust the pressure relationship between the upper first cylinder 19 (e.g., a print cylinder) and an upper second cylinder 20 (e.g. a blanket cylinder).

The support housing 12 on the gear side 32 is connected to an actuator 16 via a vertically extending linkage 15. When the actuator 16 is extended during throw-off of the print cylinder 19, the support housing 12 is pivoted in a counter clockwise direction about an axis 42 of the gear side frame 32.

Furthermore, a supporting device 17 is assigned to the support housing 12. The supporting device 17 is coupled to an actuating unit 18. The actuating unit 18 may be a pneumatic cylinder, or a hydraulic cylinder, an electric motor or a solenoid or other suitable device. The actuating unit 18 moves the supporting device 17 laterally between an engaged position and a disengaged position. In FIG. 1, the supporting device is shown in its disengaged position. As explained more fully below, in its engaged position, the supporting device 17 supports the support housing 12 during throw-off.

In the configuration shown in FIG. 1, both sides of a web 44 are printed as the web 44 moves along a web path 43 through the nip between the upper second cylinder 20, (e.g. blanket cylinder) and a lower second cylinder 30 (e.g. blanket cylinder), both cylinders 20, 30 having mounted thereon sleeve-shaped printing blankets. Moreover, the upper first cylinder 19 and lower first cylinder 29 each have tubular shaped print forms mounted thereon. Additional printing units similar to the printing unit 1 shown in FIG. 1 may also be arranged in the web path 43.

The lower inker 21 comprises a lower ink fountain 22 which supplies ink to vibrator rollers 23 of the lower inker 21. By means of applicator rollers 26, 27 and 28 ink is supplied to the lower first cylinder 29. A dampening unit 24 is assigned to the lower inker 21 and supplies dampening fluid via dampening applicator roller 25 to a sleeve-type tubular-shaped print form mounted on the lower first cylinder 29.

Figures 2A, 2B:
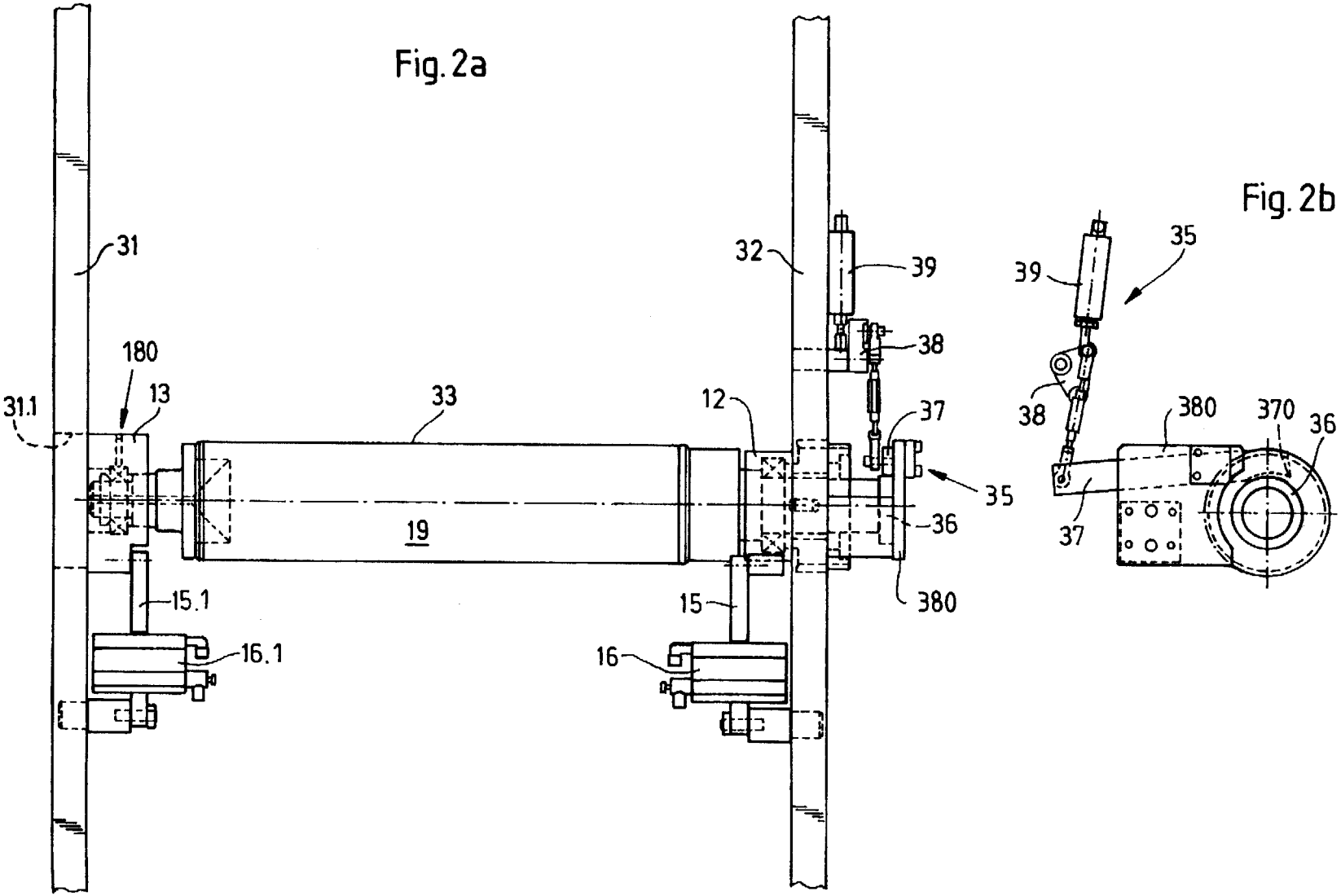
FIGS. 2(*a–c*) show a print cylinder of the upper inker of the printing unit of FIG. 1 in printing mode, a counterpoise mechanism in its disengaged position, and a releasable bearing clamp in its closed position.

FIG. 2(*a*) shows a side view of the upper first cylinder 19 mounted between a gear-side frame 32 and a work side frame 31. A counterpoising mechanism 35 is also shown. FIG. 2(*b*) shows a front view of the counterpoising mechanism 35, and FIG. 2(*c*) shows the work side frame 31 in more detail. In the configuration of FIGS. 2(*a,b,c*), the first cylinder 19 is in printing mode and the counterpoise assembly 35 is not engaged.

Attached to the work side frame 31 is an actuator 16.1, having a linkage 15.1 releasably connected to work side support housing 180. Work side support housing 180, in turn, includes a door 182 pivotably mounted to a bracket 184 and to a door actuation assembly 186. The work side support housing 180 is rotatable about an axis 188. In print mode, the work side support housing 180 supports the cylinder 19. On the gear side frame 32, the support housing 12 is rotatably mounted on the gear side frame 32 about the axis 42 as shown in FIG. 1. By engaging the actuators 16, 16.1, the support housings 12, 180 are pivoted about the axes 42, 188 via linkage 15, 15.1 (in a counter-clockwise direction from the perspective of FIG. 1) and the upper first cylinder 19 is thrown off the upper second cylinder 20 in an upward arc.

Once the upper first cylinder 19 has been thrown off, the counterpoising mechanism 35 can be activated, and then the door 182 opened to allow installation or removal of the sleeve 33. The upper second cylinder 20 remains stationary during throw-off.

Referring to FIGS. 2(*a*), 2(*b*), the counterpoising mechanism 35, shown in its disengaged position, includes an actuating device 39, e.g., a pneumatic cylinder, a toggle linkage 38 and a counterpoise lever 37 having an arc shaped portion 370 adjacent to a cylinder journal 36. The counterpoise lever 37 is pivotably mounted to a counterpoising frame 380. In its disengaged position, the arc shaped portion 370 of the lever 37 does not contact the cylinder journal 36.

Figure 2C:
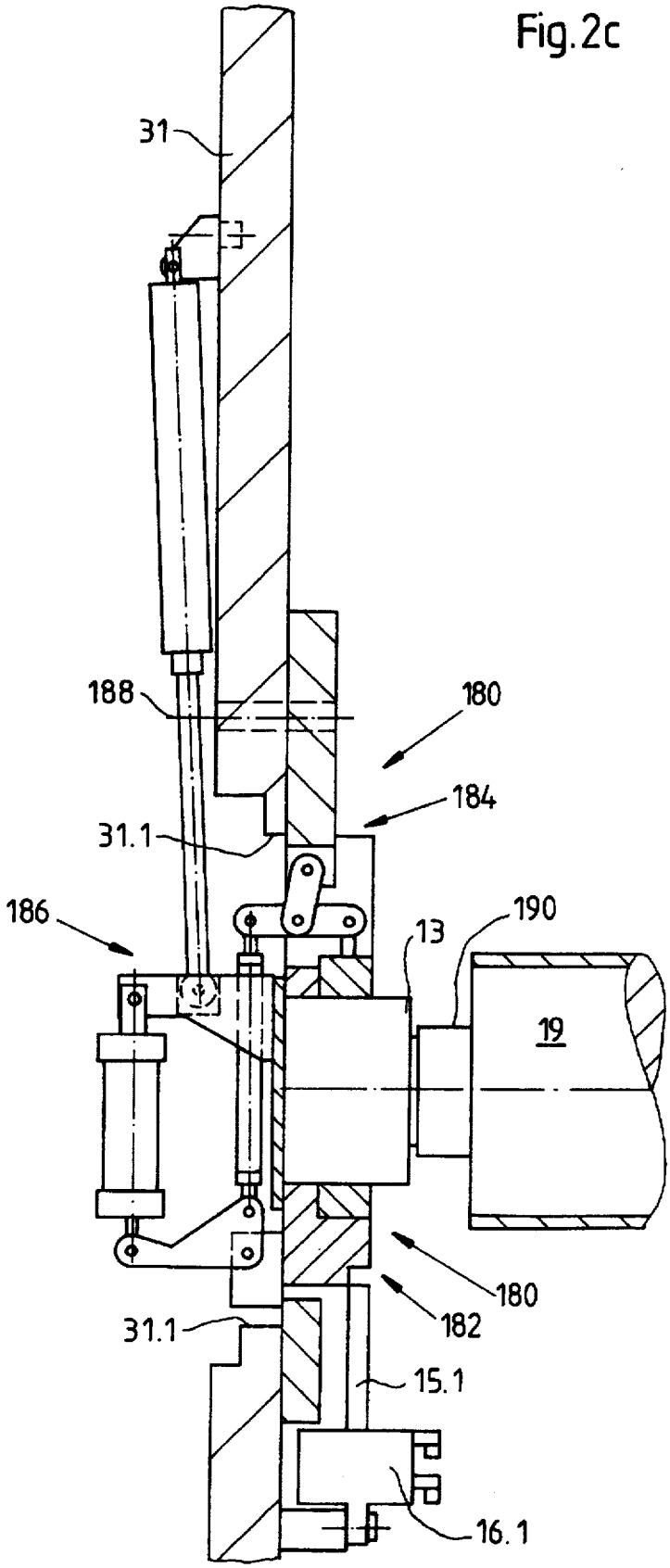
Figure 3B:
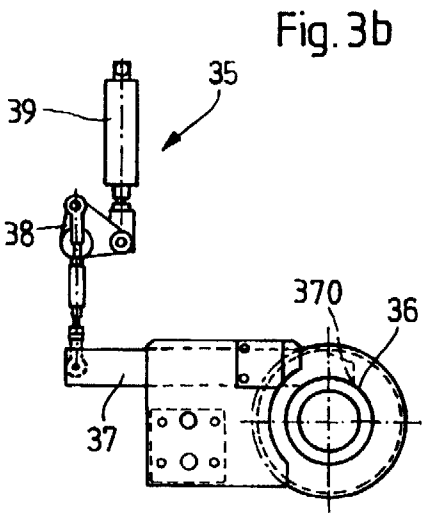
FIGS. 3(*a–c*) show a print cylinder of the upper inker of the printing unit of FIG. 1 in throw-off mode, a counterpoise mechanism in its engaged position, and a releasable bearing clamp in its open position.
Figure 3A:
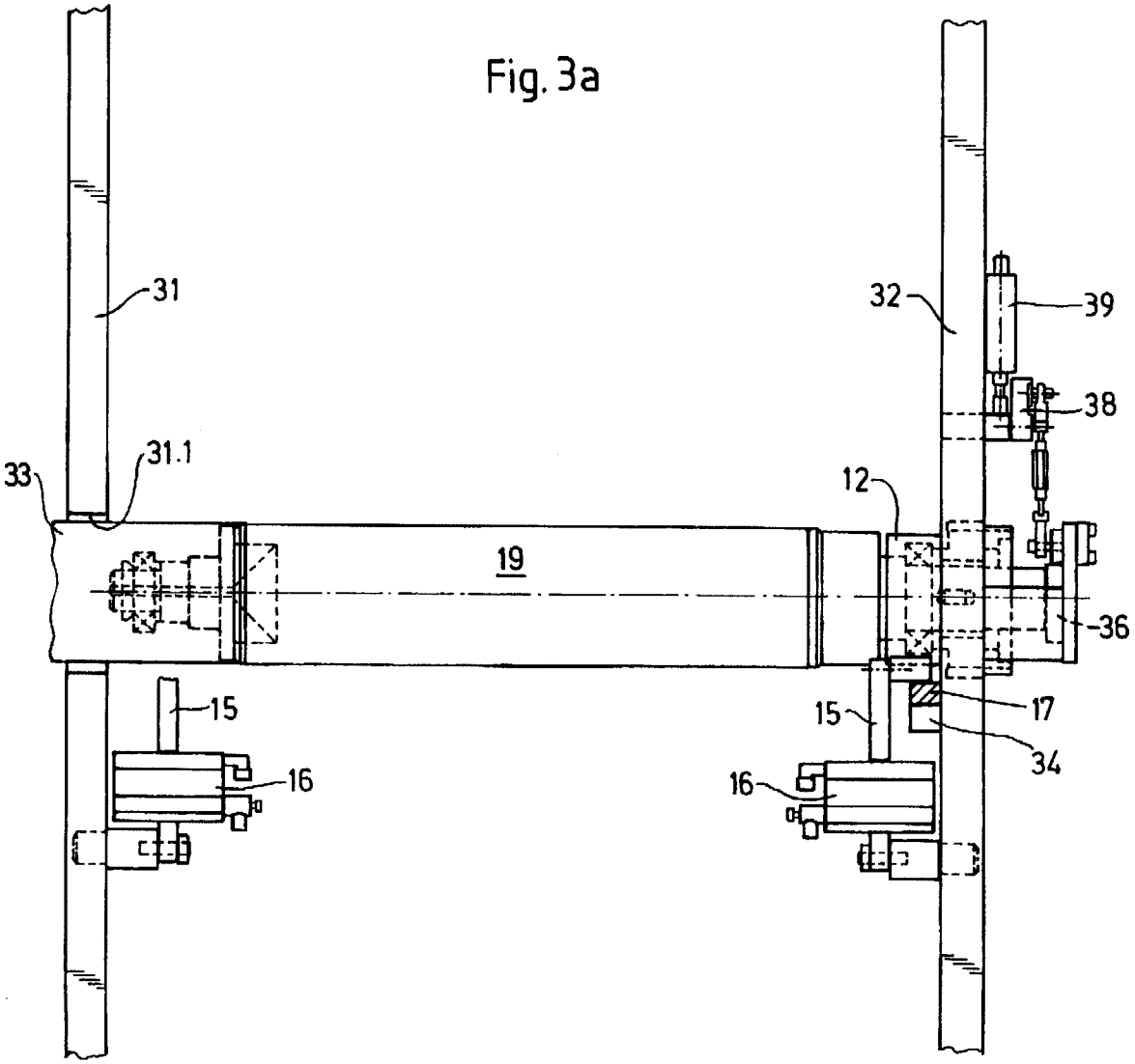

Similar to FIGS. 2(*a,b*), FIG. 3(*a*) shows the side view of the first cylinder 19 mounted between the gear-side frame 32 and a work side frame 31, and a counterpoising mechanism 35. FIG. 3(*b*) shows a front view of the counterpoising mechanism 35 and FIG. 3(*c*) shows the work side frame 31 in greater detail. However, in the configuration of FIGS. 3(*a–c*), the upper first cylinder 19 is in non-printing mode (i.e. throw-off) and the counterpoise assembly 35 is engaged.

For removal of the printing sleeve 33, the upper first cylinder 19 is moved into its throw-off position via actuators 16, 16.1 on work side and gear side frames 31, 32 respectively. Then, the counterpoising assembly 35 is activated, causing the arc shaped portion 370 of the lever 37 to contact the cylinder journal 36. Referring to FIG. 1, supporting device 17, which is slidably mounted on a slide plate 34, is activated and engages gear side support housing 12, thereby maintaining journal 36 and gear side support housing 12 in their positions.

Figure 3C:
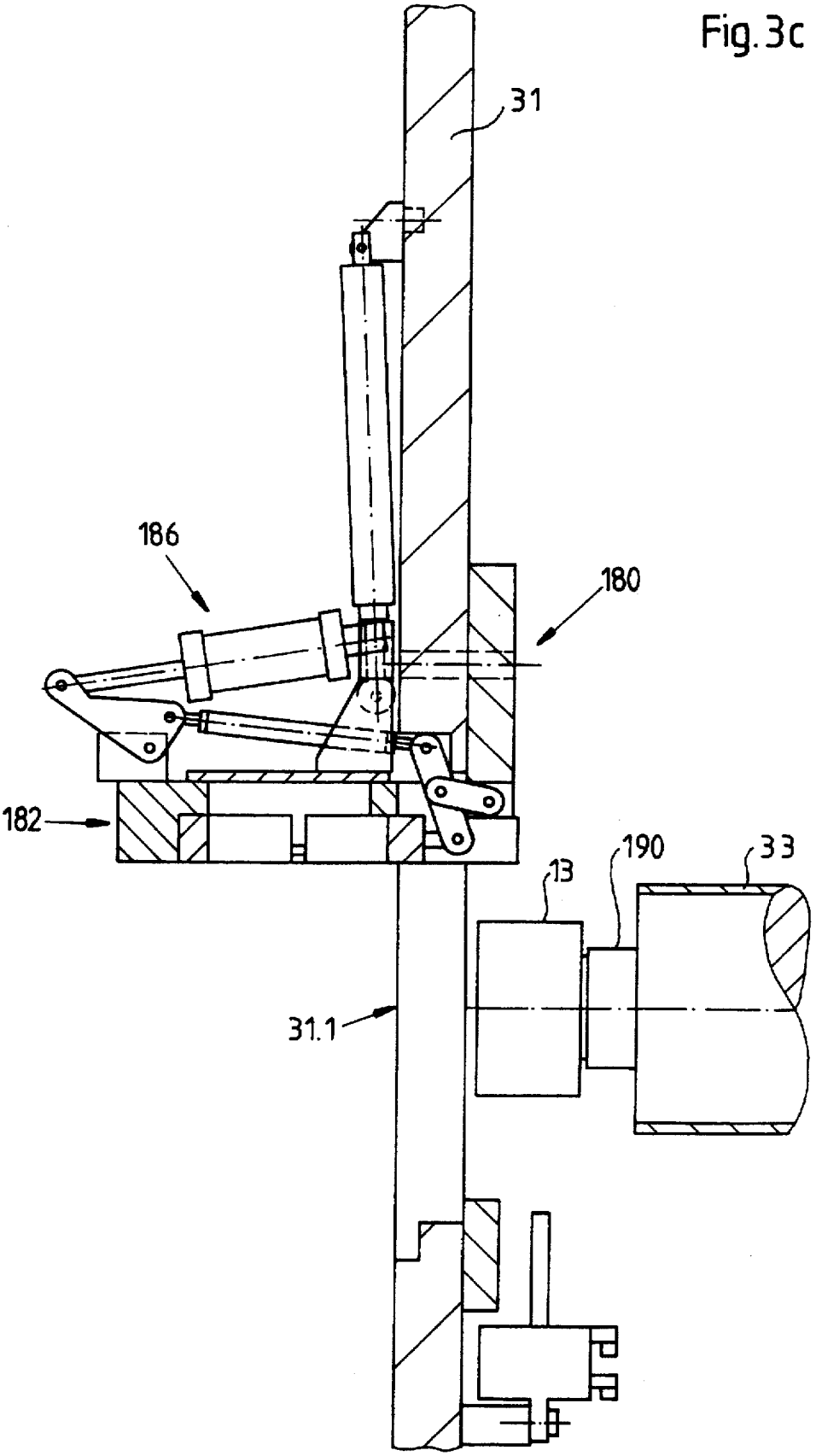

To facilitate installation of the tubular sleeve 33 on, and removal of the tubular sleeve 33 from, the upper first cylinder 19, the work side frame has an opening 31.1. Referring to FIGS. 2*c*, 3*c*, after the counterpoised assembly 35 and the supporting device 17 have been activated, the bearing housing 13 on the work side frame 31 of the upper first cylinder 19 is released, allowing for removal of the sleeve 33 through the opening 31.1 within work side frame 31. A releasable bearing clamp, such as the one shown in greater detail in U.S. Pat. No. 5,241,905, the specification of which is expressly incorporated herein by reference, allows the bearing housing 13 on the work side frame 31 to be released, thus maintaining its position on the work side frame stub shaft 190 of the upper first cylinder 19 as shown in FIG. 3(*c*).

Once the bearing housing 13 has been released, the door 182 is opened by the door actuation assembly 186 and the sleeve 33 can be installed or removed through the opening 31.1. With the bearing housing 13 released, the cylinder 19 is supported by support housing 12 and counterpoise assembly 35. Support housing 12, in turn, is held in position by actuator 16 and linkage 15. The supporting device 17 and sliding device 34 protect the cylinder 19 from damage in the event of a failure of actuator 16 or linkage 15. By configuring the actuating device 39 in the manner shown in FIGS. 2(*b*),3(*b*), with the actuating device 39 retracted while the counterpoise assembly is engaged, protection against failure of the actuating device 39 can also be provided. In fact, since the supporting device 17 supports the cylinder when the counterpoise assembly is engaged, the actuator 16 need not even be designed to support the full weight of the cylinder.

Figure 4:
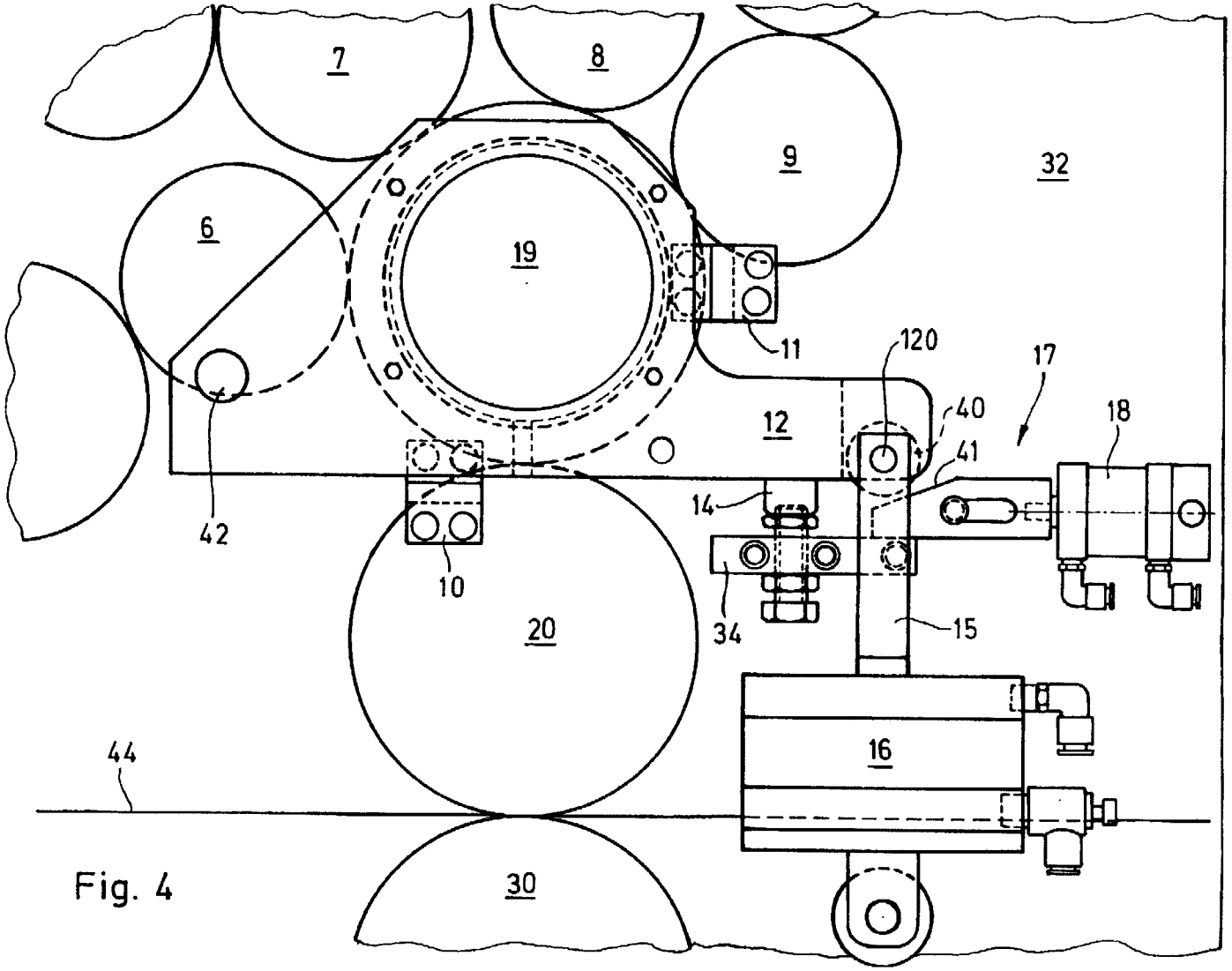
FIG. 4 shows an enlarged section of the upper inker of the printing unit of FIG. 1, the counterpoise mechanism and a supporting device being in disengaged position.

FIG. 4 shows the gear side support housing 12 in greater detail. The upper first cylinder 19 and the upper second cylinder 20 are in the printing mode. An image is transferred from the upper first cylinder 19 to the upper second cylinder 20 and then onto the surface of a web 44 traveling through the nip between upper second cylinder 20 and lower second cylinder 30. In this mode, the applicator rollers 6, 7, 8, and 9, transfer ink or dampening solution, respectively onto the surface of the upper first cylinder 19. The support housing 12 is pivotably mounted about axis 42 of the gear side frame 32. In this mode, the support housing 12 is supported by a stop 14, adjustably mounted on the slide plate 34 of the gear side frame 32. The support housing 12 is connected to the actuator 16 via linkage 15. The linkage 15 is pivotably mounted to the support housing 12 about an axis 120. On the support housing 12, a cam follower 40 is also mounted about the axis 120. The cam follower 40 cooperates with an inclined surface area 41 of the wedge shaped supporting device 17. The supporting device 17 is moved in and out of engagement with the cam follower 40 by an actuating unit 18. The actuating units 16, 16.1, 18, and 39 may, for example, be pneumatic cylinders, electric motors with or without gearing, solenoids, hydraulic actuators, or other suitable devices for actuating the supporting device 17, or linkage 15, 15.1, 38.

Figure 5:
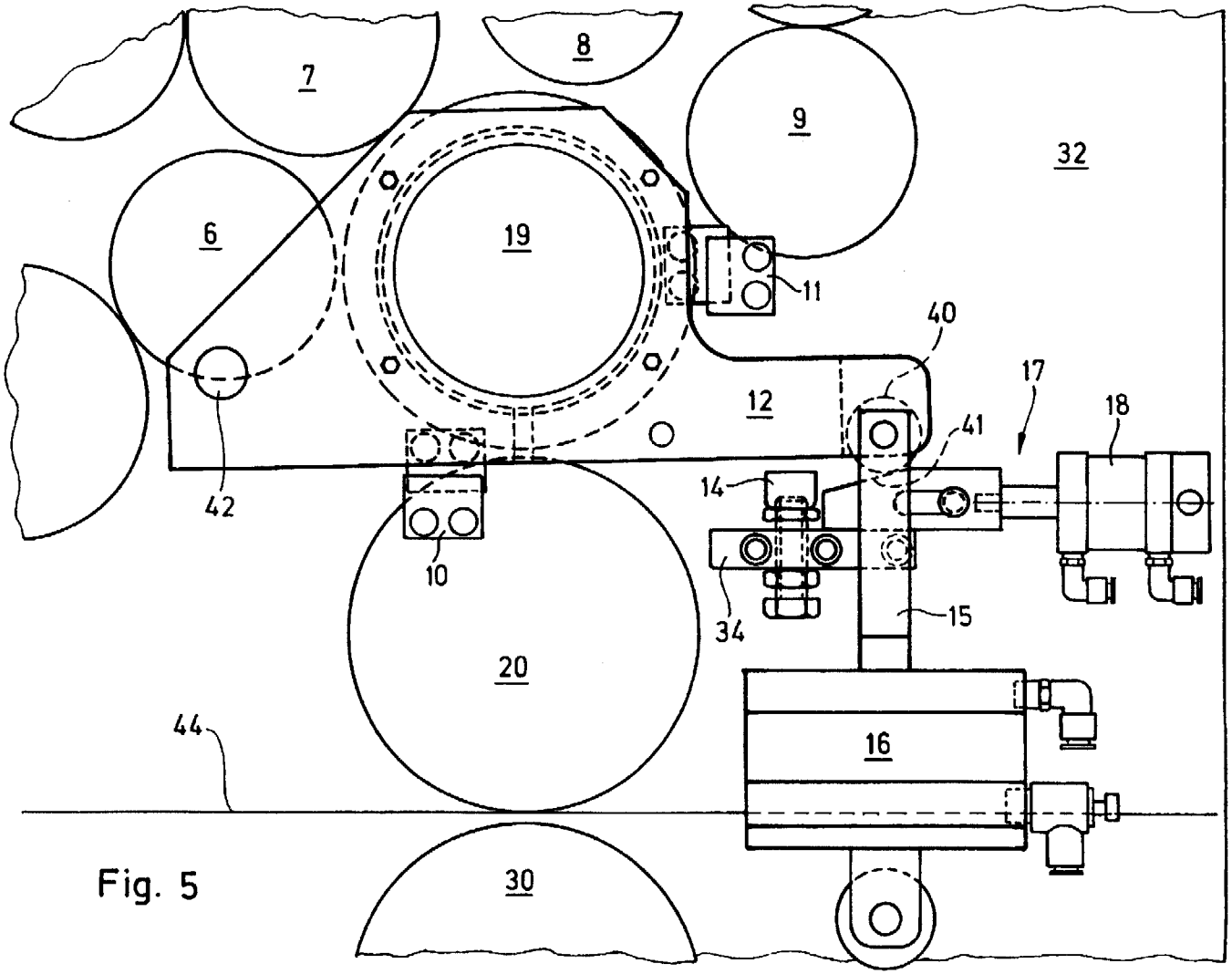
FIG. 5 shows an enlarged cross section of the upper inker of the printing unit of FIG. 1, the counterpoise mechanism and a supporting device being in engaged position.

FIG. 5 shows the support housing 12 in a thrown off position. The ink applicator rollers 7, 8, 9 as well as the dampening applicator roller 6 are thrown off from the surface of the upper first cylinder 19 by conventional means. Since the support housing 12 is slightly pivoted about axis 42, thus leaving stop 14, the upper first cylinder 19 does not contact cylinder 20 or rollers 6–9.

In order to prevent a sudden downward movement of the support housing 12 and to prevent wear and damage to the cylinder surface, wedge-shaped supporting device 17 is moved onto the slide plate 34. As explained above, the supporting device is moved laterally by the actuating unit 18. In order to reduce friction, an inclined portion 41 of the supporting element 17 contacts the cam follower 40 rotatably mounted about axis 120 on the support housing 12, thus facilitating the engagement of the supporting device 17 below the support housing 12.

As a result, having activated the supporting device 17, the upper first cylinder 19 is kept on the gear side frame 32 in its position secured by the counterpoised assembly 35 located outside of the gear side frame 32, and, in addition, by the supporting device 17, which is engaged with the cam follower 40 mounted on the support housing 12. Thus, if a sudden pressure failure occurs in an actuator 16 during removal of a sleeve, the support housing 12 is substantially kept in its thrown-off position by the supporting device 17.

Throw-off in the lower inker can be accomplished, for example, in the manner illustrated in U.S. Pat. No. 5,301,609, the specification of which is hereby incorporated by reference.

Figure 6:
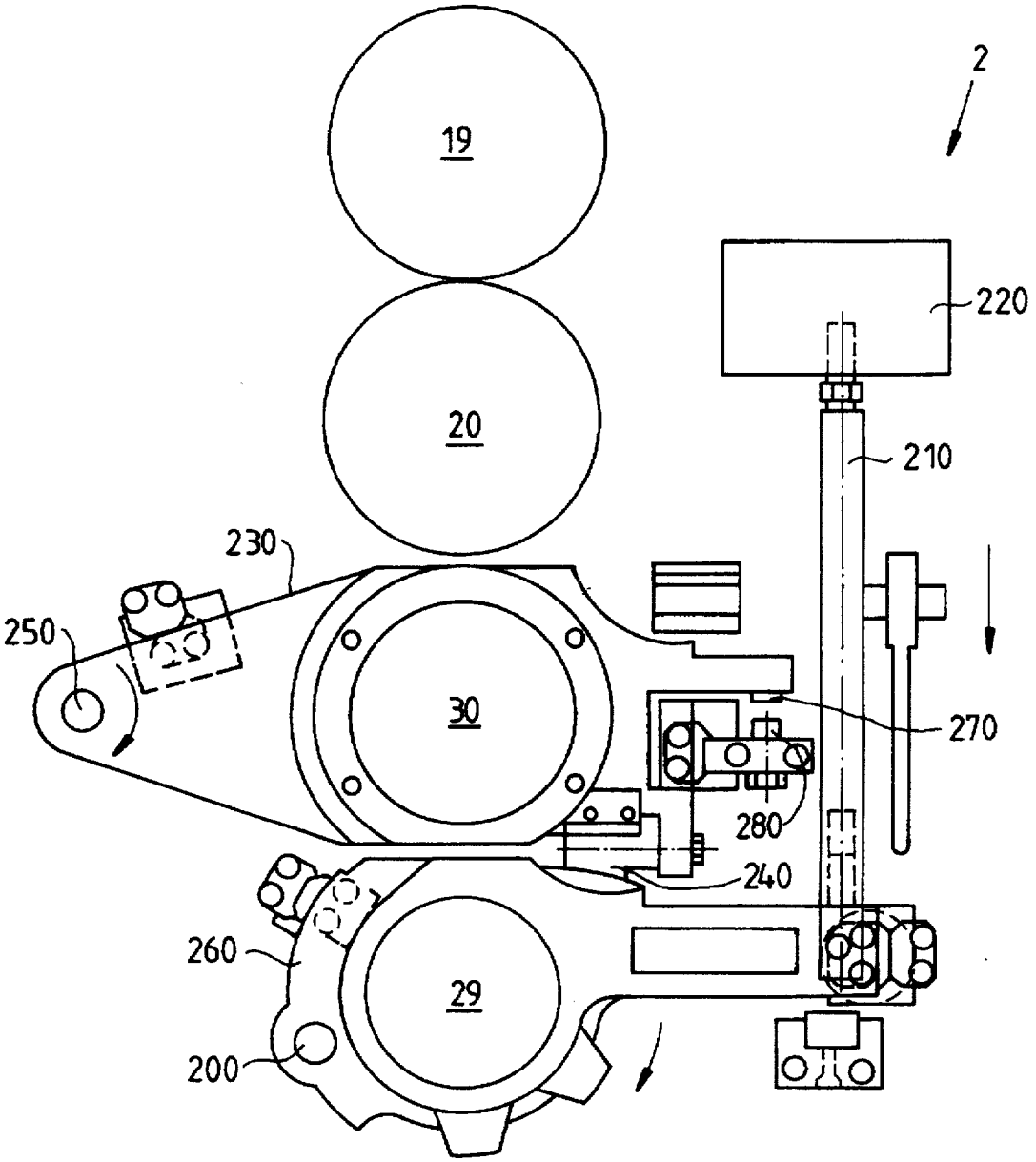
FIG. 6 shows an illustrative throw off mechanism for the lower inker of FIG. 1.

FIG. 6 shows an illustrative throw-off mechanism 290 for the lower inker 21 of FIG. 1. The throw-off mechanism 290 is shown in print position (as opposed to throw-off position). Referring to FIG. 6, the lower first cylinder 29 is mounted on a bracket 260 and can be thrown off downward about an axis 200 by a first piston 210 driven by an actuator 220. The lower second cylinder 30 is mounted on a bracket 230. The bracket 230, includes a stop 240, and is rotatably mounted about an axis 250. In the print position, the piston 210 holds the bracket 260 and lower first cylinder 29 in position. The bracket 230 and lower second cylinder 30 is held in position by the stop 240 which rests on the bracket 260. When the piston 210 extends, the bracket 260 rotates the lower first cylinder 29 about the axis 200 and into throw-off position. As this rotation occurs, the force of gravity causes the bracket 230 to rotate the lower second cylinder 30 in a clock-wise direction until a stop 270 contacts a block 280. After the rotation of the bracket 230 is stopped by the block 280, the bracket 260 will continue to rotate under pressure from the piston 210, thereby separating the lower second cylinder 30 from both the upper second cylinder 20 and the lower first cylinder 29. As set forth above, the upper first cylinder 19 is thrown-off upwards from the upper second cylinder 20 in the manner shown in FIGS. 1–5. The upper second cylinder 20 remains stationary during throw-off.

Figure 7:
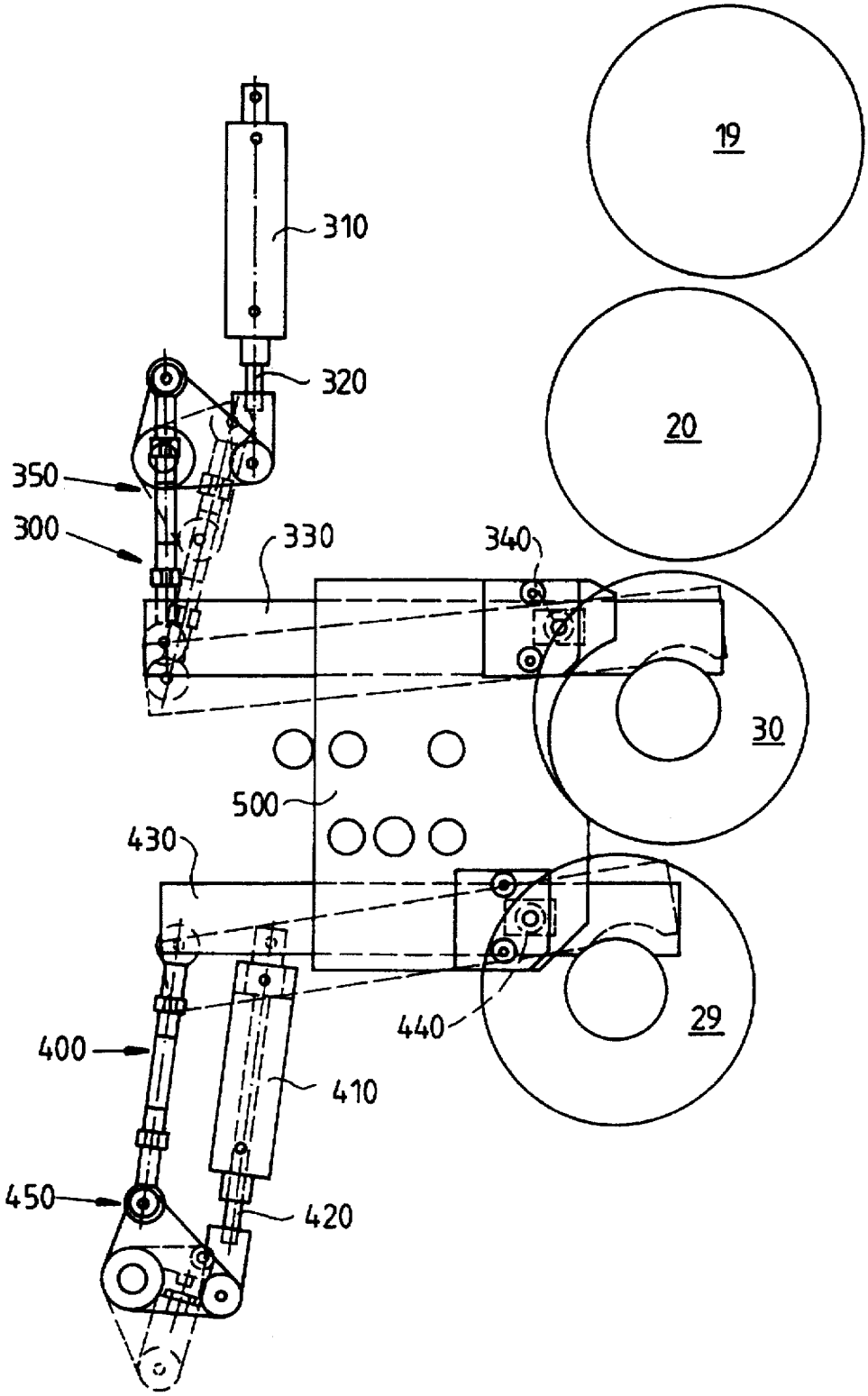
FIG. 7 shows an illustrative counterpoise mechanism for the lower inker of FIG. 1

If the lower first and second cylinders of FIG. 1 are configured to accepted sleeve shaped blankets and print forms (respectively), then the lower first and second cylinders can be supported, during installation and removal of the sleeves, in the manner illustrated in U.S. Pat. No. 5,237,920, the specification of which is hereby incorporated by reference. Referring to FIG. 7, an upper counterpoise assembly 300 and lower counterpoise assembly 400 hold the lower second cylinder 30 and the lower first cylinder 29, respectively, in position while the sleeves are installed or removed.

In order to engage the upper counterpoise assembly 300, an actuator 310 drives a piston 320 outward causing linkage assembly 350 to rotate lever 330 in a clockwise direction about axis 340 so that an arced portion of the lever 330 engages the surface of the journal 36 of the lower second cylinder 30. In order to engage the lower counterpoise assembly 300, an actuator 410 drives a piston 420 outward causing linkage assembly 450 to rotate lever 430 in a clockwise direction about axis 440 so that an arced portion of the lever 430 engages the surface of the journal 36 of the lower first cylinder 29. Once the upper counterpoise assembly and/or lower counterpoise assembly are engaged, the bearings on the work side frame 31 of the respective cylinder(s) can be released, and the respective sleeve(s) installed or removed. An illustrative manner in which the bearings of the upper first cylinder, upper second cylinder, lower first cylinder, and lower second cylinder can be released is described more fully in U.S. Pat. No. 5,241,905, the specification of which is hereby incorporated by reference.

In the configurations of FIGS. 1–7, the present invention has been illustrated for a double-sided offset lithographic printing press in which the upper first cylinder is thrown-off upward, the upper second cylinder remains stationary, and the lower first and second cylinders are thrown-off downward. However, the present invention is not limited to such a configuration. For example, the counterpoise and lift mechanism illustrated in FIGS. 1, 2(*a–b*), 3(*a–b*), 4, and 5, could also be applied to a printing press in which the lower first cylinder were held stationary during throw-off, and the lower second, upper second, and upper first cylinders were all thrown-off upwards.

Similarly, the counterpoise and lift mechanism illustrated in FIGS. 1, 2(*a–b*), 3(*a–b*), 4, and 5, could also be applied to a printing press in which the lower second cylinder were held stationary during throw-off, the upper second, and upper first cylinders were thrown-off upwards, and the lower first cylinder thrown-off downwards. Finally, all four cylinders could be thrown-off upwards. The present invention is also applicable to single-sided offset lithographic printing presses having a blanket cylinder, a print cylinder, and an impression cylinder.

In addition, the present invention is by no means limited to use in offset lithographic printing presses. It is applicable to any processing device which utilizes sleeve mounted members. For example, the counter-poise and lift mechanism according to the present invention could be used in conjunction with other image carrying cylinders such as gravure, intaglio, letter press, flexographic, or electronically imaged cylinders.

What is claimed is:

1. A counterpoise and lift mechanism for moving a processing unit cylinder between a printing position and a throw-off position, the mechanism comprising:

a cylinder having a first end and a second end, an axially mountable form removably mounted over the first end, the cylinder supported on the first and second ends by respective first and second support housings;

a throw-off mechanism coupled to the first and second support housings, the throw-off mechanism moving the cylinder upward from the printing position to the throw-off position, and moving the cylinder downward from the throw-off position to the printing position;

a counterpoise assembly engageable with an exterior portion of the second end of the cylinder, the second support housing engaging an interior portion of the second end of the cylinder, the counterpoise assembly applying a force to the second end of the cylinder when the cylinder is in the throw-off position, the counterpoise assembly releasing the force from the second end of the cylinder when the cylinder is in the printing position; and a supporting device, the supporting device engaging and supporting the second support housing when the cylinder is in the throw-off position.

2. The mechanism according to claim 1, further comprising a sliding device, the sliding device supporting the supporting device in throw-off position.

3. The mechanism according to claim 1, wherein the cylinder is a plate cylinder.

4. The mechanism according to claim 1, wherein the cylinder is a blanket cylinder.

5. The mechanism according to claim 1, wherein the cylinder is an impression cylinder.

6. The mechanism according to claim 1, wherein the first and second support housings pivot about respective axes between the printing position and the throw-off position.

7. The mechanism according to claim 1, wherein the cylinder is an image carrying cylinder such as gravure, intaglio, letter press, flexographic, or electronically imaged cylinder.

8. The mechanism according to claim 1, further comprising a pair of adjustable stop members, each adjustable stop member engaging a respective support housing to adjust pressure between the cylinder and an adjacent cylinder.

9. The mechanism according to claim 1, wherein the second support housing further includes a contacting member, the contacting member being engaged by the supporting device in the throw-off position.

10. The mechanism according to claim 9, wherein the supporting device further includes a contacting area for engaging the contacting member in the throw-off position.

11. The mechanism according to claim 10, wherein the contacting area has an inclined surface.

12. The mechanism according to claim 1, wherein the supporting device further comprises a actuating unit for moving the supporting device.

13. The mechanism according to claim 12, wherein the actuating unit is electronically controlled.

14. The mechanism according to claim 13, wherein the actuating unit is a solenoid.

15. The mechanism according to claim 12, wherein the actuating unit is a pneumatic cylinder.

16. The mechanism according to claim 12, wherein the actuating unit is a hydraulic actuator.

17. The mechanism according to claim 1, wherein the counterpoise assembly further includes a counterpoise lever coupled to an actuator, the counterpoise lever having an arced portion for engaging a gear side journal of the cylinder.

18. The mechanism according to claim 1, wherein the throw-off mechanism further includes a first and second actuator; and a first and second linkage coupled between the respective first and second actuators and the first and second support housings.

19. The mechanism according to claim 1, wherein the first and second support housing are pivotable about respective axes on respective side frames of a processing unit.

20. The mechanism according to claim 1, further comprising:

a release mechanism for releasing the first support housing from the first end of the cylinder after engagement of the counterpoise assembly and the supporting device.

21. A counterpoise and lift mechanism for moving a processing unit cylinder between a printing position and a throw-off position, the mechanism comprising:

a cylinder having a first end and a second end, an axially mountable form removably mounted over the first end, the cylinder supported on the first and second ends by respective first and second support housings;

a throw-off mechanism coupled to the first and second support housings, the throw-off mechanism moving the cylinder upward from the printing position to the throw-off position, and moving the cylinder downward from the throw-off position to the printing position;

a counterpoise assembly engageable with an exterior portion of the second end of the cylinder, the second support housing engaging an interior portion of the second end of the cylinder, the counterpoise assembly applying a force to the second end of the cylinder when the cylinder is in the throw-off position, the counterpoise assembly releasing the force from the second end of the cylinder when the cylinder is in the printing position; and a supporting device, the supporting device engaging and supporting the second support housing when the cylinder is in the throw-off position;

the second support housing further including a contacting member, the contacting member being engaged by the supporting device in throw-off position, the supporting device further including a contacting area for engaging the contacting member in the throw-off position, the contacting area having an inclined surface, the contacting area being rotatably mounted on the second support housing, the contacting member engaging the contacting area in a low friction manner as the supporting device moves into engagement with the second support housing.

* * * * *